US006854987B2

(12) United States Patent
Wu

(10) Patent No.: US 6,854,987 B2
(45) Date of Patent: Feb. 15, 2005

(54) ELECTRICAL CONNECTOR ASSEMBLY

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/208,949

(22) Filed: Jul. 29, 2002

(65) Prior Publication Data

US 2004/0018759 A1 Jan. 29, 2004

(51) Int. Cl.[7] ..... H01R 4/66
(52) U.S. Cl. ..... 439/108
(58) Field of Search ..... 439/108, 607, 439/608, 609, 610, 939, 564, 573, 660, 493, 79, 83

(56) References Cited

U.S. PATENT DOCUMENTS 4,157,612 A * 6/1979 Rainal ..... 29/628
4,579,404 A * 4/1986 Lockard ..... 439/14 R
4,643,509 A * 2/1987 Hollyday et al. ..... 439/147 R

* cited by examiner

*Primary Examiner*—Gary Paumen
*Assistant Examiner*—Phuongchi Nguyen
(74) *Attorney, Agent, or Firm*—Wei Te Chung

(57) ABSTRACT

An electrical connector assembly (1) comprises a dielectric housing (10), a plurality of pairs of upper and lower signal and grounding contacts (20, 30) alternately retained to the housing, and a circuit board (40). Each pair of upper and lower grounding contacts are detachable from each other and conductively contact with each other after assembled with the housing. The circuit board forms a plurality of solder pads (42) on opposite top and bottom surfaces (44, 46) thereof and each soldered pad is electrically connected to a corresponding signal or grounding contact and a corresponding conductive conductor of an electrical cable at opposite ends thereof.

7 Claims, 11 Drawing Sheets

ELECTRICAL CONNECTOR ASSEMBLY

CROSS-REFERENCE TO RELATED APPLICATION

This application is a related to U.S. Patent Application with an unknown serial number, entitled "ELECTRICAL CONNECTOR", invented by the same inventor, assigned to the common assignee as the present application. The disclosure of the co-pending application is wholly incorporated herewith by reference.

BACKGROUND OF THE INVENTION

1. Field of the Invention

The present invention relates to an electrical connector assembly, and particularly to an electrical connector assembly having improved grounding contacts.

2. Description of Prior Art

Nowadays, high-density electrical connectors are commonly used in computer industry to meet the high speed and high frequency signal transmission between two electronic components. The high density connector generally comprises a plurality of grounding contacts alternately disposed among a plurality of signal contacts thereof for reducing or minimizing cross-talk between the signal contacts, as disclosed in U.S. Pat. No. 6,183,302, issued to Osamu Daikuhara et al. on Feb. 6, 2001; and U.S. Pat. No. 5,046,960, issued to James L. Fedder on Sep. 10, 1991. Osamu Daikuhara et al. discloses a high-density connector which includes a dielectric housing, a plurality of signal and grounding contacts alternately disposed in the dielectric housing. Each of the grounding contacts, shaped in a plate-like, is a single piece and has a contact beam inserted through the dielectric housing for engaging with a complementary connector. Such a grounding contact is simple in structure and in assembly, but the contact beam thereof is easily deformed or damaged during assembly, thereby adversely affecting the electrical connection with the complementary connector. Thus, effective grounding function of the grounding contacts can not ensured.

Hence, an electrical connector assembly with improved grounding contacts is required to overcome the disadvantages of the prior art.

BRIEF SUMMARY OF THE INVENTION

A first object of the present invention is to provide an electrical connector assembly having an improved grounding contact which can ensure a reliable grounding function.

A second object of the present invention is to provide an electrical connector assembly having an improved circuit board with a relative short circuit trace.

To fulfill the above-mentioned objects, an electrical connector assembly in accordance with the present invention comprises a dielectric housing, a plurality of pairs of upper and lower signal contacts, a plurality of pairs of upper and lower grounding contacts, and a circuit board. The dielectric housing defines a plurality of pairs of upper and lower passageways for receiving the upper and lower signal contacts and a plurality of through slots alternately arranged with the plurality of pairs of upper and lower passageways. Each pair of upper and lower grounding contacts are detachable from each other and received in a common through slot. The circuit board forms a plurality of solder pads on opposite top and bottom surfaces thereof and each soldered pad is electrically connected to a corresponding signal or grounding contact and a corresponding conductive conductor of an electrical cable at opposite ends thereof.

Other objects, advantages and novel features of the invention will become more apparent from the following detailed description of the present embodiment when taken in conjunction with the accompanying drawings.

DETAILED DESCRIPTION OF THE INVENTION

Figure 1:
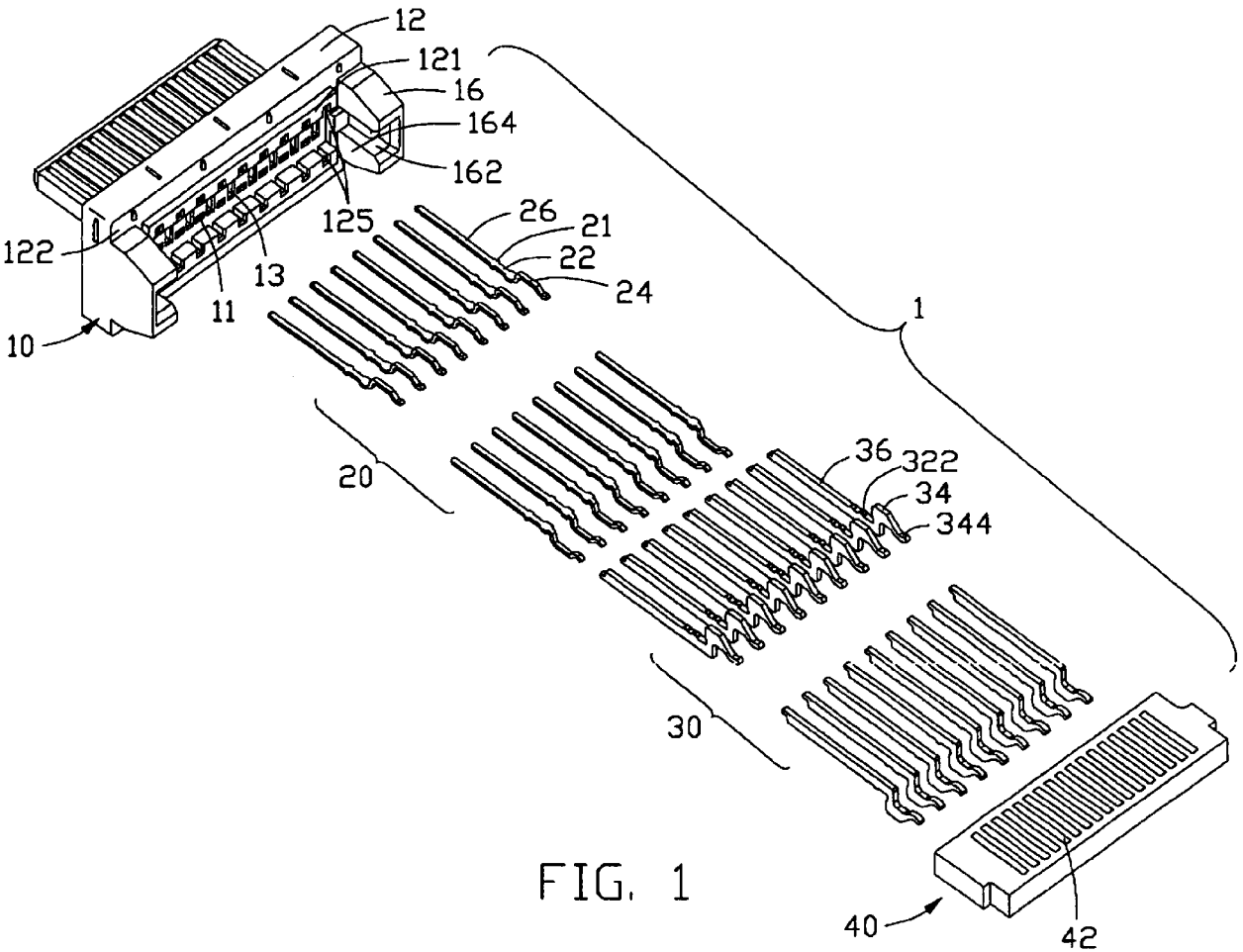
FIG. 1 is an exploded perspective view of an electrical connector assembly in accordance with the present invention.

Reference will now be made to drawings, and particularly to FIG. 1, an electrical connector assembly 1 in accordance with the present invention comprises a dielectric housing 10, a plurality of pairs of signal and grounding contacts 20, 30 retained to the dielectric housing 10, and a circuit board 40.

Figure 2:
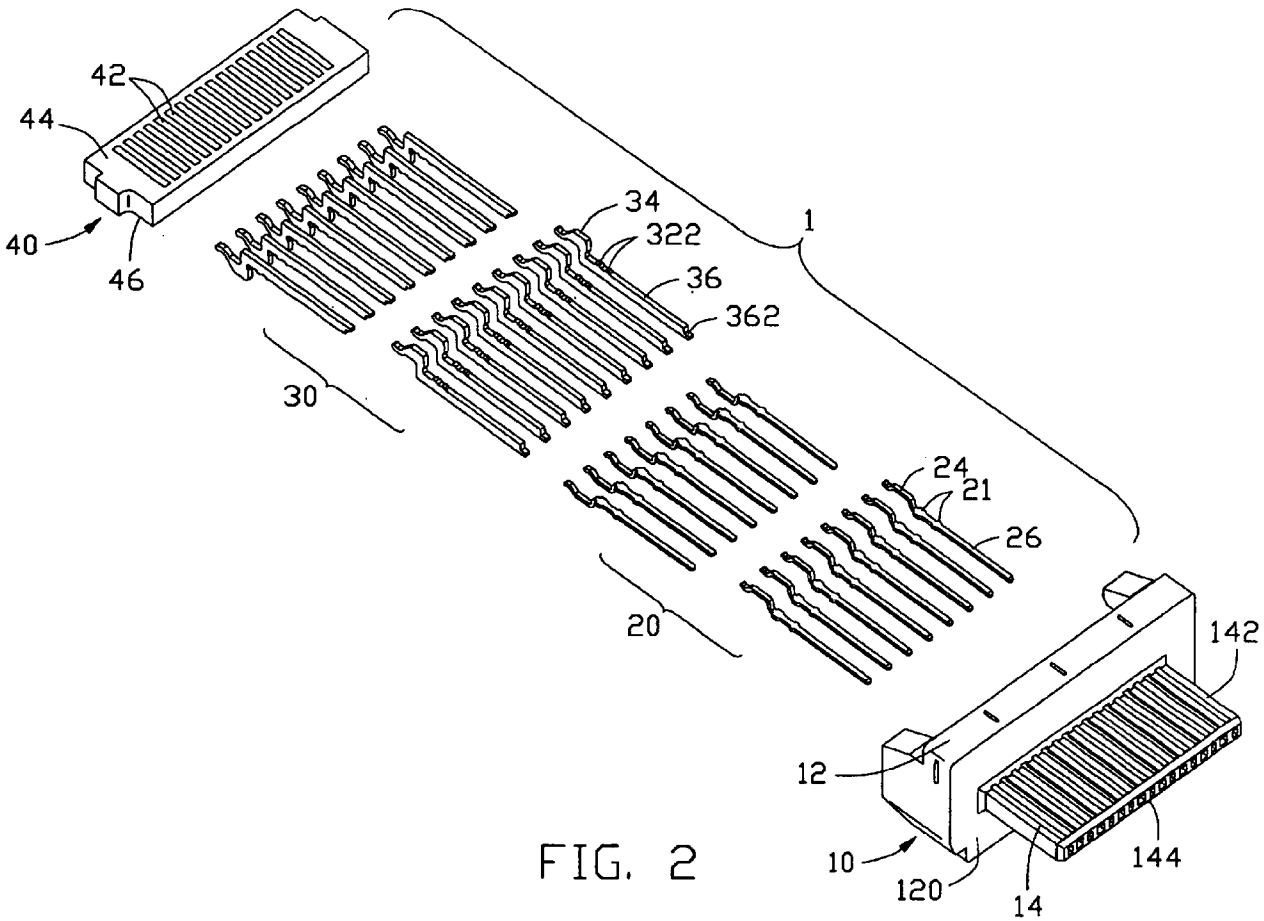
FIG. 2 is a view similar to FIG. 1 but from another aspect.
Figure 3:
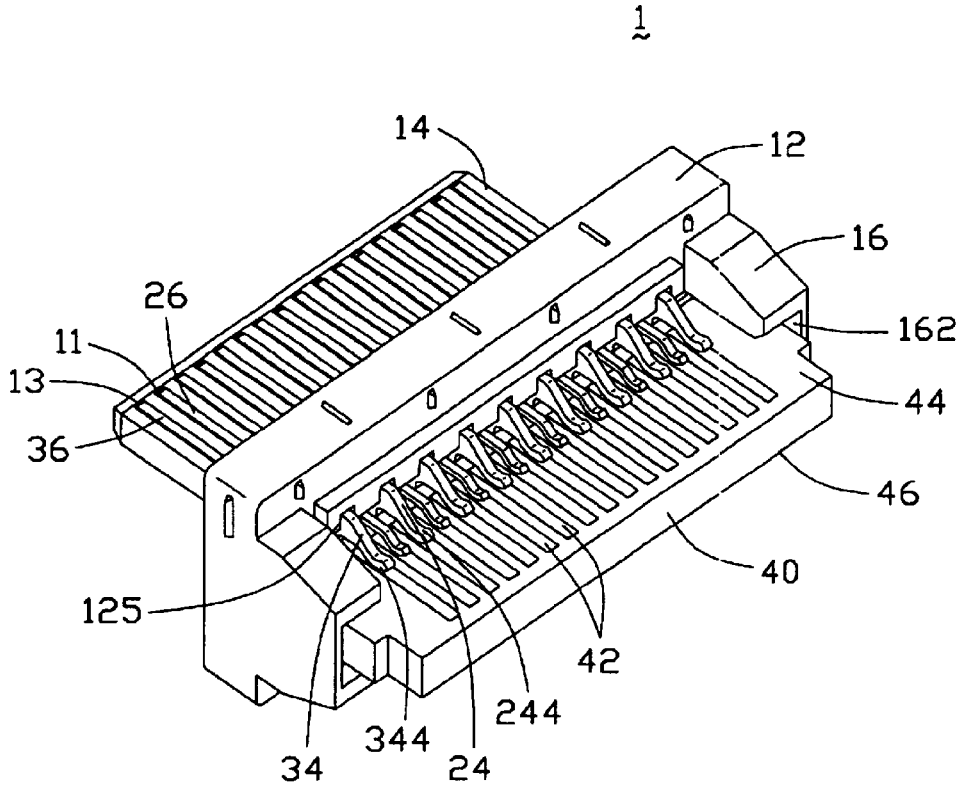
FIG. 3 is an assembled view of FIG. 1.
Figure 4:
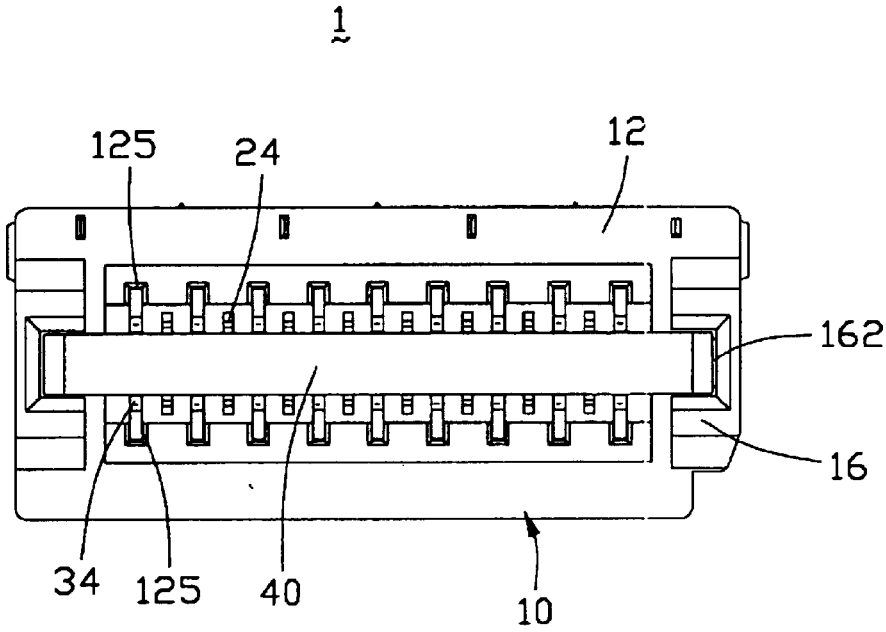
FIG. 4 is a front view of FIG. 3.
Figure 5:
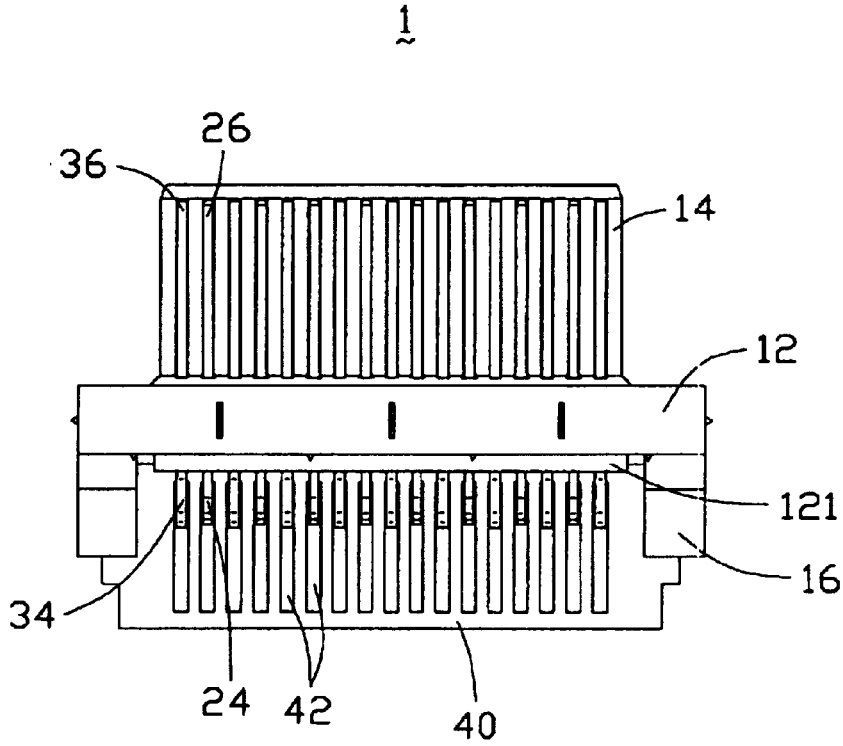
FIG. 5 is a top view of FIG. 3.
Figure 7:
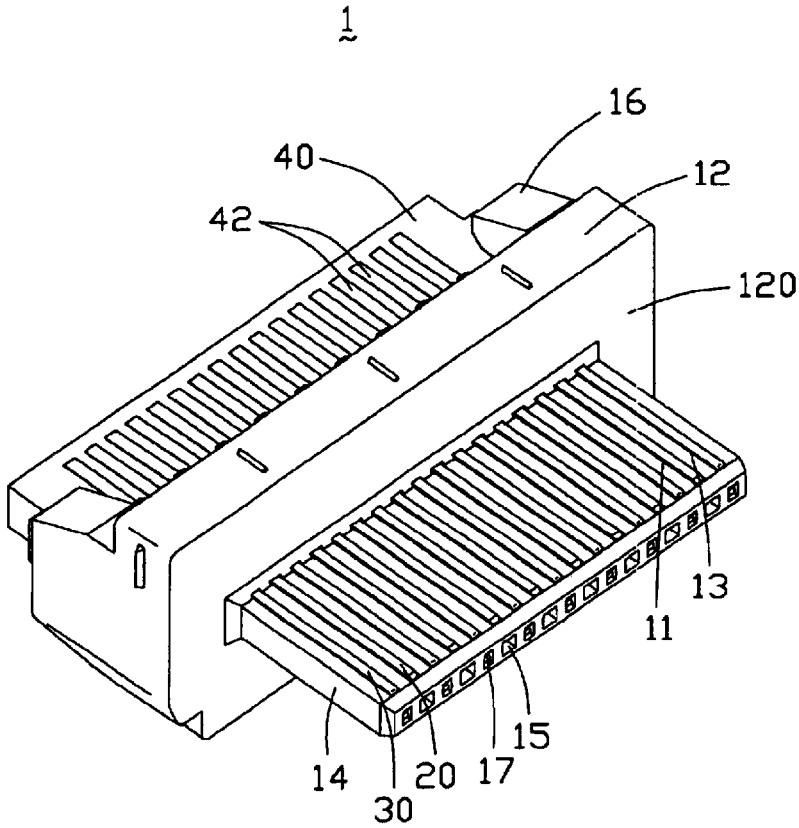
FIG. 7 is an assembled view of FIG. 2.
Figure 8:
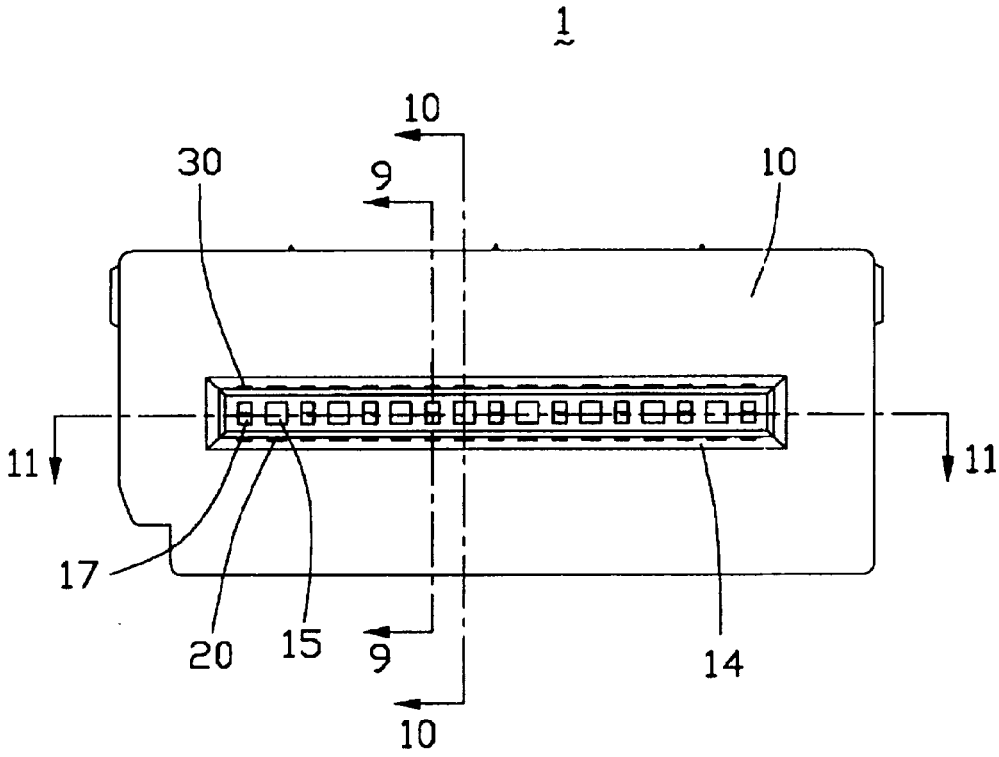
FIG. 8 is a front view of FIG. 7.
Figure 9:
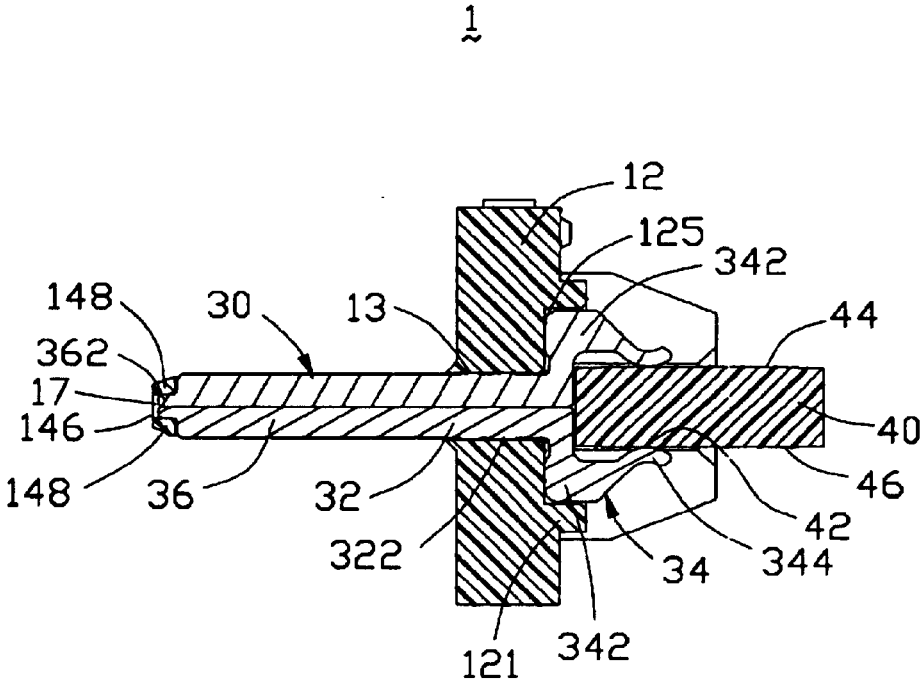
FIG. 9 is a cross-sectional view taken along line 9—9 of FIG. 8.
Figure 10:
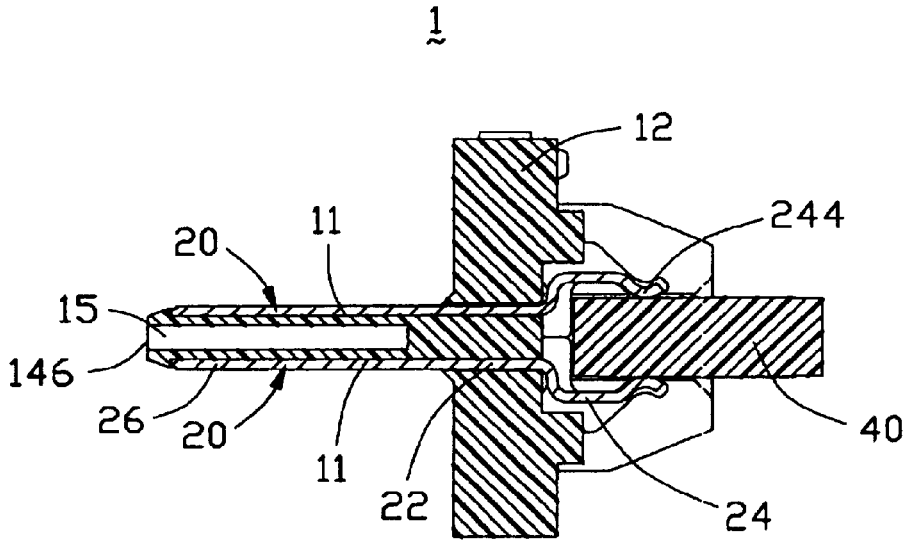
FIG. 10 is a cross-sectional view taken along line 10—10 of FIG. 8.

Further referring to FIG. 2, the dielectric housing 10 has a body portion 12, a mating block 14 and a pair of side wings 16 extending from opposite front and rear faces 120, 122 of the body portion 12, respectively. As best seen in FIG. 10, the dielectric housing 10 defines a plurality of pairs of upper and lower passageways 11 and each pair of upper and lower passageways 11 extends through the body portion 12 and into opposite upper and lower surfaces 142, 144 of the mating block 14, respectively, for receiving a corresponding pair of upper and lower signal contacts 20. An elongated tunnel 15 is defined in an outer face 146 of the mating block 14 and between each pair of upper and lower passageways 11. Further referring to FIGS. 7 and 9, a plurality of through slots 13 each extend through the body portion 12 and through the upper and lower surfaces 142, 144 of the mating block 14, and are alternately arranged with the plurality of pairs of upper and lower passageways 11, for receiving corresponding pairs of upper and lower grounding contacts 30. An opening 17 is further defined in the outer face 146 of the mating block 14 and communicates with each through slot 13, relative narrower than the through slot 13, thereby forming a pair of tapered stoppers 148 beside the opening 17. Referring back to FIG. 1, the body portion 12 further forms a pair of elongated ribs 121 projected on the rear face 122 thereof and the elongated ribs 121 define a plurality of pairs of cutouts 125. Each pair of cutouts 125 is aligned and communicated with a corresponding through slot 13. Additionally, each side wing 16 defines a channel 162 in an inner surface 164 thereof for receiving the circuit board 40.

Further referring to FIG. 10, the pair of upper and lower signal contacts 20 have a symmetric structure with respect to each other and each has a retaining portion 22, a contact portion 24 and a mating beam 26 extending from opposite ends of the retaining portion 22. The retaining portion 22 forms several barbs 21 on opposite sides thereof for interferingly retaining to a corresponding one of the upper and lower passageways 11 in the body portion 12. The contact portion 24 extends vertically and then horizontally from the retaining portion 22 and forms an arc contact point 244 at a free end thereof for soldering to the circuit board 40.

Figure 11:
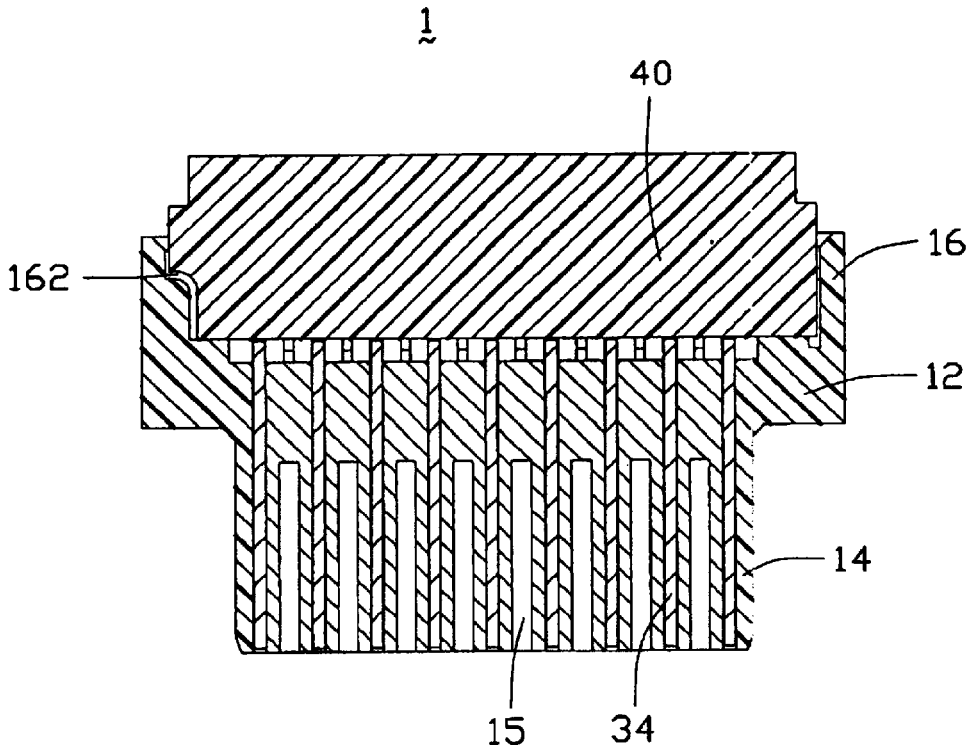
FIG. 11 is a cross-sectional view taken along line 11—11 of FIG. 8.

Referring to FIG. 11, each pair of upper and lower grounding contacts 30 is substantively similar to the pair of upper and lower signal contacts 20 in structure. The pair of upper and lower grounding contacts 30 are in two-pieces and also have a symmetric structure with respect to each other. Each grounding contact 30 has a wider cross section taken along the length thereof than that of the signal contact 20 and has a retaining portion 32, a contact portion 34 and a mating beam 36 extending from opposite ends of the retaining portion 32. The retaining portion 32 forms several barbs 322 on a lateral side thereof for retaining to a corresponding through slot 13 in the body portion 12 of the dielectric housing 10. The contact portion 34 forms an enlarged portion 342 vertically extending from the retaining portion 32 for being accommodated into a corresponding cutout 125 of the dielectric housing 10. An arc contact point 344 is formed at the free end of the contact portion 34 for soldering to the circuit board 40. The mating beam 36 is received in a corresponding through slot 13 in the mating block 14 and forms a slim end 362 received into the opening 17 and retained by the pair of tapered stoppers 148 associated with the corresponding through slot 13.

Referring to FIG. 1 again, the circuit board 40 has an elongated shape and forms a plurality of elongated solder pads 42 on opposite top and bottom surfaces 44, 46 thereof. One end of each solder pad 42 is adopted for being soldered to a corresponding contact point 244 or 344 of the signal or grounding contact 20, 30, and the other end thereof is adopted for being soldered to a corresponding conductive conductor of an electrical cable (not shown). Thus, the conductive conductors of the electrical cable are directly and electrically connected to corresponding signal or grounding contacts 20, 30 by the solder pads 42, and conventional circuit traces which are electrically connected between corresponding solder pads formed on opposite ends of a circuit board are omitted for the circuit board 40. Therefore, the circuit board 40 is relative narrow with respect to a conventional circuit board, which remains a relative large space the electrical cable routing. Additionally, the relative short solder pad 42 with respect to the circuit trace combined with two opposite solder pads of the conventional circuit board provides a good performance for signal transmission between the signal contact 20 and a corresponding conductive conductor of the electrical cable.

Figure 6:
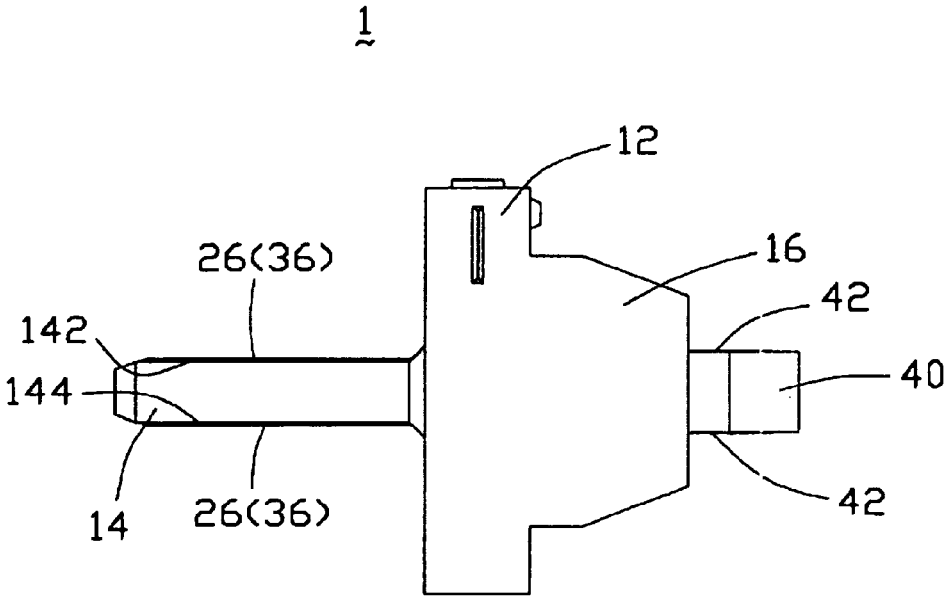
FIG. 6 is a side view of FIG. 3.

In assembly, further referring to FIGS. 3 to 8, the pairs of upper and lower signal contacts 20 are inserted into corresponding upper and lower passageways 11 from the back of the dielectric housing 10. The pairs of upper and lower grounding contacts 30 then pass through corresponding pairs of upper and lower cutouts 125 of the ribs 121 into the aligned through slots 13 of the dielectric housing 10 and are thus alternately arranged among the pairs of upper and lower signal contacts 20. As best seen in FIG. 6, the mating beams 26/36 the upper and lower signal/grounding contacts 20/30 slightly project beyond the upper and lower surfaces 142, 144 of the mating block 14, respectively, for mating with a complementary connector (not shown). Each pair of upper and lower grounding contacts 30 are abutted against with each other when they are retained to a common through slot 13 of the dielectric housing 10 and the enlarged portions 342 thereof are accommodated into a corresponding pair of cutouts 125. The barbs 322 of each pair of upper and lower grounding contacts 30 are interferingly fitted with the corresponding through slot 13 in body portion 12. Meanwhile, the slim ends 362 of each pair of upper and lower grounding contacts 32 are accommodated into a corresponding opening 17 associated with the corresponding through slot 13 and retained by the adjacent tapered stoppers 148 of the dielectric housing 10, thereby the pair of upper and lower grounding contacts 30 reliably retained in position. The circuit board 40 is then fitted into the receiving slots 162 of the side wings 16 and is sandwiched between the contact portions 24 and 34 of the pairs of upper and lower signal and grounding contacts 20 and 30. The contact points 244, 344 of the signal and grounding contacts 20, 30 are conductively contacting corresponding solder pads 42 on the top and bottom faces 44, 46 of the circuit board 40. It is noted that since each pair of upper and lower grounding contacts 30 is in two-pieces, the contact portions 34 thereof provides more flexibility with respect to those of the grounding contact in a single piece, thereby, during the circuit board 40 coupled to the dielectric housing 10 and the soldering course, the two contact portions 34 thereof are not easily deformed or damaged with respect to those of the prior art. Therefore, a reliable grounding function of the grounding contacts 30 of the present invention is achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising: a dielectric housing defining a plurality of pairs of upper and lower passageways and a plurality of through slots alternately arranged with the plurality of pairs of upper and lower passageways;

a plurality of pairs of upper and lower signal contacts received into the pairs of upper and lower passageways;

a plurality of pairs of upper and lower grounding contacts, each pair of upper and lower grounding contacts being discrete from each other and conductively contacting with each other when they are received in a common through slot;

wherein the electrical connector assembly further comprises a circuit board which forms a plurality of solder pads on opposite top and bottom surfaces thereof for conductively contacting corresponding signal contacts and grounding contacts;

wherein each solder pad of the circuit board has an elongated shape and one end thereof is soldered to a corresponding signal or grounding contact and another end thereof is to be soldered to a corresponding conductor of an electrical cable;

wherein the dielectric housing includes a body portion, a mating block extending from a front face of the body portion and a pair of side wings extending from a rear face of the body portion;

wherein each pair of upper and lower passageways extend through the body portion into upper and lower surfaces of the mating block, respectively, and an elongated tunnel is defined in an outer surface of the mating block and locates between the each pair of upper and lower passageways;

wherein each through slot extends through the body portion and through the upper and lower surfaces of the mating block;

wherein an opening is defined in the outer surface of the mating block and communicates with each through slot;

wherein a pair of elongated ribs extend from the rear surface of the body portion and form a plurality of pairs of upper and lower cutouts aligned with corresponding through slots; and wherein the pair of side wings extend from opposite ends of the rear surface of the body portion and each side wing defines a channel in an inner face thereof for receiving the circuit board.

2. The electrical connector assembly as claimed in claim 1, wherein each pair of upper and lower grounding contacts have a symmetric structure with respect to each other and are abutted against with each other after insertion into the corresponding through slot.

3. The electrical connector assembly as claimed in claim 2, wherein each of the upper and lower grounding contacts has a retaining portion forming barbs retained to a corresponding through slot in the body portion, a contact portion and a mating beam extending from opposite ends of the retaining portion.

4. The electrical connector assembly as claimed in claim 3, wherein the contact portion of each grounding contact forms an enlarged portion vertically extending from the retaining portion for being accommodated into a corresponding one of the pair of upper and lower cutouts and an arc contact point at a free end thereof for being soldered to a corresponding solder pad on the circuit board.

5. The electrical connector assembly as claimed in claim 4, wherein the mating beams of the pair of upper and lower grounding contacts extend slightly beyond the upper and lower surfaces of the mating block, respectively, for mating with a complementary connector and each mating beam forms a slim end interferingly retained to a corresponding opening of the mating block.

6. An electrical connector assembly comprising:

a dielectric housing having a body portion with a mating block extending therefrom;

a plurality of through slots extending through the body portion and continuing through both upper and lower surfaces of the mating block; and plural pairs of grounding contacts each grounding contact has a retaining portion, a contact portion and a mating beam extending from opposite ends of the retaining portion; respectively received in the corresponding slots, each one of said pairs of grounding contacts including a pair of discrete opposite mirror type grounding contacts, said pair of grounding contacts including a pair of said mating beams back to back abutting against each other through the through slots and respectively exposed on the upper and lower surfaces of the mating block, a pair of said retaining portions with outer barbs engaged with the body portion to retain said pair of grounding contacts, and a pair of said contact portions commonly defining therebetween a space in which a front edge of a printed circuit board is received.

7. The assembly as claimed in claim 6, wherein each pair of grounding contacts is located in a plane perpendicular to the upper and the lower surfaces of said mating block.

* * * * *